US009699851B2

(12) United States Patent
Yagi et al.

(10) Patent No.: US 9,699,851 B2
(45) Date of Patent: Jul. 4, 2017

(54) DIMMING LIGHTING CIRCUIT AND LUMINAIRE

(71) Applicant: Panasonic Intellectual Property Management Co., Ltd., Osaka (JP)

(72) Inventors: Satoshi Yagi, Osaka (JP); Kei Mitsuyasu, Osaka (JP); Shinichiro Goto, Osaka (JP); Tomohiro Sugiura, Mie (JP); Katsuyoshi Nakada, Gumma (JP)

(73) Assignee: Panasonic Intellecutal Property Management Co., Ltd., Osaka (JP)

( * ) Notice: Subject to any disclaimer, the term of this patent is extended or adjusted under 35 U.S.C. 154(b) by 0 days.

(21) Appl. No.: 15/171,444

(22) Filed: Jun. 2, 2016

(65) Prior Publication Data

US 2016/0366741 A1 Dec. 15, 2016

(30) Foreign Application Priority Data

Jun. 9, 2015 (JP) ..... 2015-116957

(51) Int. Cl.
*H05B 33/08* (2006.01)
*H05B 41/392* (2006.01)

(52) U.S. Cl.
CPC ..... *H05B 33/0845* (2013.01); *H05B 33/0815* (2013.01); *H05B 41/3924* (2013.01)

(58) Field of Classification Search
CPC ..... H05B 33/0815; H05B 33/0845; H05B 39/08; H05B 41/3924; H05B 33/0812; H05B 33/0866; H05B 39/048
USPC ..... 315/194, 247, DIG. 4
See application file for complete search history.

(56) References Cited

U.S. PATENT DOCUMENTS

2012/0242237 A1* 9/2012 Chen ..... H05B 33/0815 315/200 R
2013/0234612 A1* 9/2013 Zeng ..... H05B 37/02 315/200 R
2015/0201477 A1 7/2015 Watanabe et al.
2016/0135265 A1* 5/2016 Eum ..... H05B 33/0812 315/307

FOREIGN PATENT DOCUMENTS

JP 2008-104273 5/2008
JP 2012-054223 3/2012
JP 2013-214515 10/2013
JP 2014-017202 1/2014
JP 2014-130697 7/2014

* cited by examiner

*Primary Examiner* — Tuyet Vo
(74) *Attorney, Agent, or Firm* — Renner, Otto, Boisselle & Sklar, LLP

(57) ABSTRACT

A dimming lighting circuit includes: a rectifier circuit; a phase detection circuit which outputs a dimming signal having a signal level corresponding to a conduction phase angle of an AC voltage; and a DC-DC converter which receives a DC voltage output from the rectifier circuit and supplies a light source with a DC current corresponding to the signal level of the dimming signal output from the phase detection circuit. If the conduction phase angle detected when the dimming lighting circuit receives the AC voltage at power-on is less than or equal to a predetermined angle, the phase detection circuit outputs, as the dimming signal, a substitute signal having a signal level corresponding to a conduction phase angle greater than the conduction phase angle of the AC voltage, for a predetermined time period.

5 Claims, 6 Drawing Sheets

DIMMING LIGHTING CIRCUIT AND LUMINAIRE

CROSS REFERENCE TO RELATED APPLICATION

This application claims the benefit of priority of Japanese Patent Application Number 2015-118957 filed on Jun. 9, 2015, the entire content of which is hereby incorporated by reference.

BACKGROUND

1. Technical Field

The present disclosure relates to dimming lighting circuits and luminaires, and relates in particular to a dimming lighting circuit and a luminaire which receive a phase-controlled AC voltage and supplies a light source with a DC current.

2. Description of the Related Art

For phase-control dimming lighting circuits, which receive a phase-controlled AC voltage and supply a light source with a DC current, techniques for solving various problems caused by phase control have been proposed (see Patent Literature 1 (PTL 1): Japanese Unexamined Patent Application Publication No. 2008-104273, for example).

The dimming lighting circuit disclosed in PTL 1 includes: a phase detection circuit which detects a conduction phase angle in phase control in one half cycle of the supplied AC voltage; and a control unit which controls a DC output current of a DC-DC converter circuit by constant current control based on the detection output of the phase detection circuit. This makes it possible to control the DC output current to cause the DC output current not to fluctuate at every half cycle of the AC voltage even when the conduction phase angle in the phase control in one half cycle of the phase-controlled AC voltage and the conduction phase angle in the phase control in the other half cycle of the phase-controlled AC voltage are not exactly the same. This yields an advantageous effect that fluctuations of light output are less noticeable even when the dimming level is low.

SUMMARY

The dimming lighting circuit of PTL 1, however, has a problem that when the power is turned on with a low dimming level it takes a long time for light corresponding to the dimming level to be output (a lighting start-up time).

This problem is significant especially with a dimming lighting circuit of a Power Factor Correction (PFC) one-converter type which, integrates a PFC circuit and a DC-DC converter. With the PFC one-converter type, a low-capacity capacitor is used for smoothing the rectified AC voltage, and a high-capacity capacitor is used as the output stage of the DC-DC converter which generates a DC voltage suitable for the light source by switching the DC voltage obtained through the smoothing of the rectified AC voltage. For this reason, when the power is turned on with a low dimming level it takes time to charge the high-capacity capacitor (output smoothing capacitor) connected to the output stage of the DC-DC converter, thus causing the lighting start-up time to be long. For example, according to an experiment conducted by the inventors, a conventional dimming lighting circuit requires 10 seconds ox longer as the lighting start-up time when the power is turned on with the dimming level set at the lower limit (for example, a dimming level equivalent to 2% to 3% of the maximum light output).

In view of this, it is an object of the present disclosure to provide a phase-control dimming lighting circuit and a luminaire which suppress a long lighting start-up time even when the power is turned on with a low dimming level.

To achieve the above object, a dimming lighting circuit according to an aspect of the present disclosure is a dimming lighting circuit which receives an AC voltage which is phase-controlled, and supplies a light source with a DC current, the dimming lighting circuit including: a rectifier circuit which rectifies the AC voltage to output a DC voltage; a phase detection circuit which detects a conduction phase angle of the AC voltage and outputs a dimming signal having a signal level corresponding to the conduction phase angle detected; and a converter which receives the DC voltage output from the rectifier circuit and supplies the light source with a DC current corresponding to a signal, level of the dimming signal output from the phase detection circuit, wherein, if the conduction phase angle detected when the dimming lighting circuit receives the AC voltage at power-on is less than or equal to a predetermined angle, the phase detection circuit outputs, as the dimming signal, a substitute signal having a signal level corresponding to a conduction phase angle greater than the conduction phase angle detected, for a predetermined time period.

Furthermore, to achieve the above object, a luminaire according to an aspect of the present disclosure is a luminaire including: a light source; and the above-described dimming lighting circuit which supplies the light source with a DC current.

The dimming lighting circuit and the luminaire according to the present disclosure suppress a long lighting start-up time even, when the power is turned on with a low dimming level.

BRIEF DESCRIPTION OF DRAWINGS

The figures depict one or more implementations in accordance with the present teaching, by way of examples only, not by way of limitations. In the Figures, like reference numerals refer to the same or similar elements.

DETAILED DESCRIPTION OF THE EMBODIMENT

Hereinafter, an embodiment of the present disclosure will be described in detail with accompanying drawings. It is to be noted that the embodiment described below is to show a preferable specific example of the present disclosure. The numerical values, shapes, materials, structural elements, the arrangement and connection of the structural elements, steps, the processing order of the steps etc., shown in the following embodiment are mere examples, and are therefore not intended to limit the present disclosure. Furthermore, among the structural elements in the following embodiment, structural elements not recited in any one of the independent claims representing the most generic concepts of the present disclosure are described as arbitrary structural element s of a more preferable embodiment.

Figure 1:
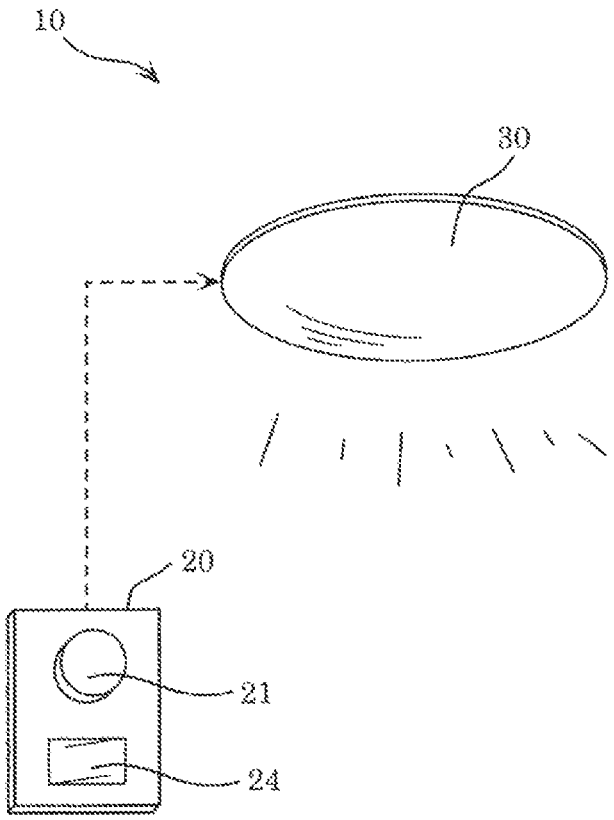
FIG. 1 is an external view of a dimming system according to an embodiment.

FIG. 1 is an external view of dimming system 10 according to an embodiment. Dimming system 10 includes dimming device 20 and luminaire 30. Dimming device 20 is a controller provided on, for example, a wall of a room, and includes power switch 24 for lighting luminaire 30 and dial 21 for adjusting the dimming level. Luminaire 30 is lighting equipment provided on, for example, a ceiling of a room.

Figure 2:
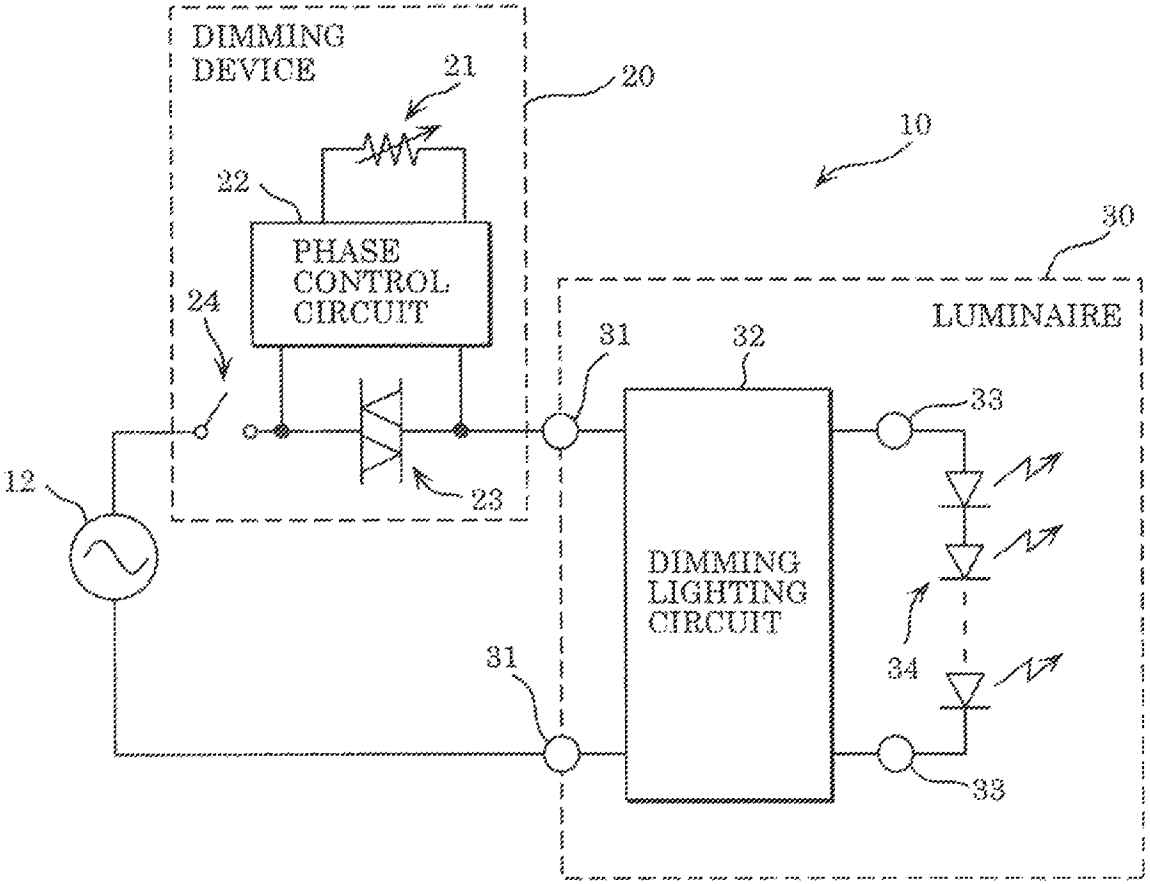
FIG. 2 is a circuit diagram of the dimming system illustrated in FIG. 1.

FIG. 2 is a circuit diagram of dimming system 10 illustrated in FIG. 1. Dimming device 20 and luminaire 30 are connected to AC power source 12 in series. AC power source 12 is a power source which supplies dimming system 10 with power, and is a commercial AC power source, for example.

Dimming device 20 includes dial 21, phase control circuit 22, triac 23, and power switch 24. Dial 21 is a variable resistor. Phase control circuit 22 is a circuit which controls triac 23 to turn triac 23 on and off at the conduction phase angle corresponding to the resistance value of dial 21. Power switch 24 is a switch to turn on and off the power supply from AC power source 12.

Luminaire 30 is equipment which emits light when an AC voltage phase-controlled by dimming device 20 is received, and includes input terminals 31, dimming lighting circuit 32, output terminals 33, and light source 34. The AC voltage phase-controlled by dimming device 20 is applied to input terminals 31. From the phase-controlled AC voltage input from input terminals 31, dimming lighting circuit 32 supplies light source 34 with a DC current via output terminals 38. Light source 34 is a light source which emits light when a current is received from dimming lighting circuit 32, and is a light-emitting diode (LED), for example.

Figure 3:
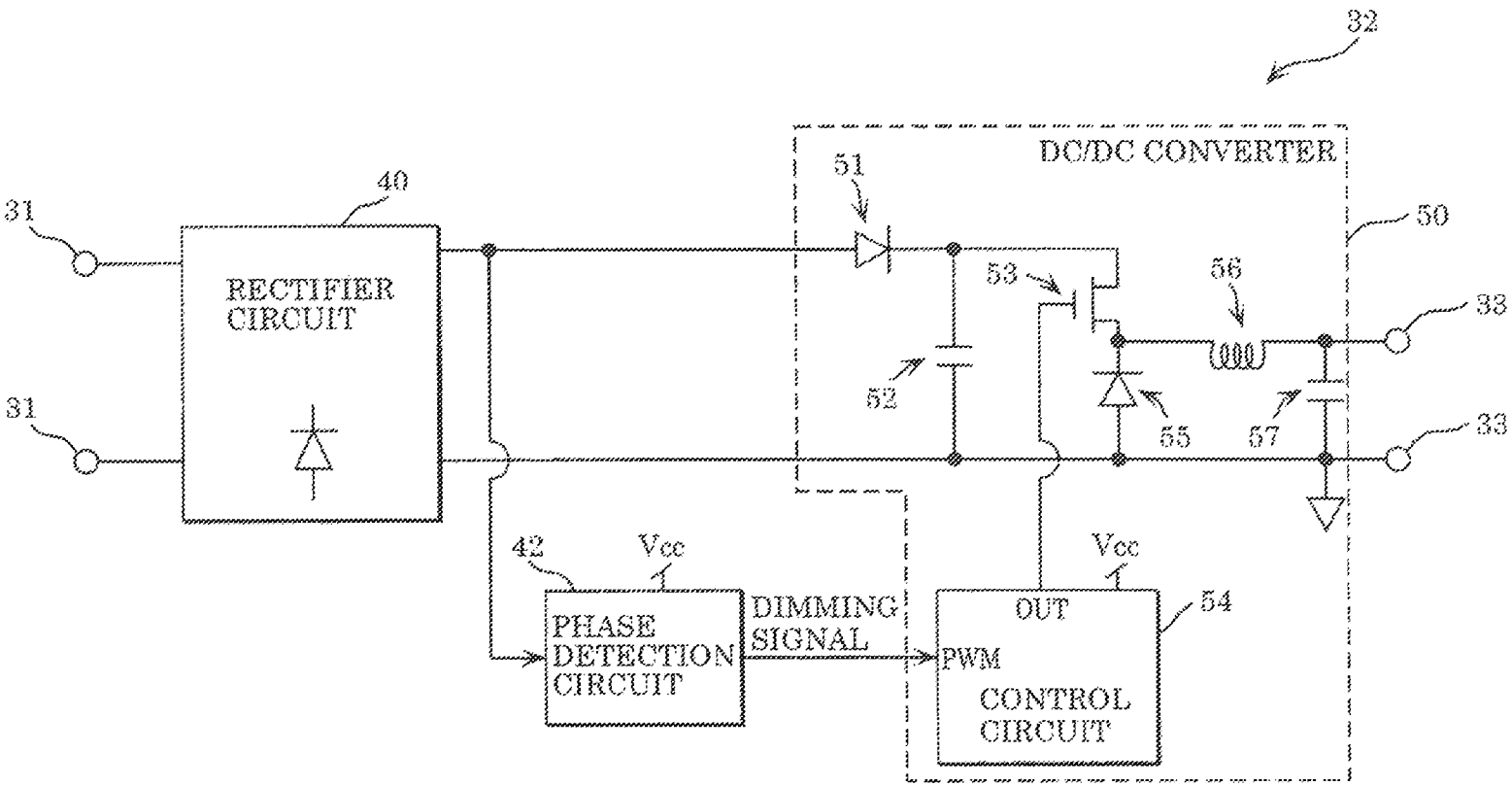
FIG. 3 is a circuit diagram of the dimming lighting circuit illustrated in FIG. 2.

FIG. 3 is a circuit diagram of dimming lighting circuit 32 illustrated in FIG. 2. Dimming lighting circuit 32 according to the present embodiment is a power source of the PFC one-converter type, and includes rectifier circuit 40, phase detection circuit 42, and DC-DC converter 50.

Rectifier circuit 40 is a circuit which rectifies the phase-controlled AC voltage input from input terminals 31 and outputs a DC-voltage, and is a diode bridge, for example.

Phase detection circuit 42 is a circuit which detects the conduction phase angle of the phase-controlled AC voltage input from input terminals 31, and outputs a dimming signal having a signal level corresponding to the conduction phase angle detected, to DC-DC converter 50 (more specifically, control circuit 54). In the present embodiment, phase detection circuit 42 detects the conduction phase angle from the waveform of the voltage rectified by rectifier circuit 40, generates a dimming signal having a voltage corresponding to the conduction phase angle detected, and outputs the dimming signal to DC-DC converter 50.

DC-DC converter 50 is an example of a converter which receives the DC voltage output from rectifier circuit 40 and supplies light source 34, via output terminals 33, with a DC current corresponding to the signal level of the dimming signal output from phase detection circuit 42. In the present embodiment, DC-DC converter 50 is a buck converter and includes diode 51, input smoothing capacitor 52, switching element 53, diode 55, inductor 56, output smoothing capacitor 57, and control circuit 54. Control circuit 54 is a circuit which controls, according to the signal level of the dimming signal output from phase detection circuit 42 and input to a pulse width modulation (PWM) terminal the DM period of switching element 53 when switching element 53 is switched at high frequency by a control signal output from the OUT terminal. Control circuit 54 is embodied by a microcomputer or the like having a built-in program. From the viewpoint of improving the power factor of dimming lighting circuit 32, input smoothing capacitor 52 is a low-capacity (e.g., 0.1 μF or less) capacitor, and output smoothing capacitor 57 is a high-capacity (e.g., 1000 μF or greater) capacitor. The voltage rectified by rectifier circuit 40 is, after passing through diode 51, smoothed by input smoothing capacitor 52, and chopped by switching element 53 under the control of control circuit 54. For the time period in which switching element 53 is ON (also referred to as ON period of switching element 53), a current flows over a path from rectifier circuit 40, diode 51, switching element 53, inductor 56, output smoothing capacitor 57, light source 84, and back to rectifier circuit 40. For the time period in which switching element 53 is OFF (also referred to as OFF period of switching element 53), a current flows over a loop path formed by inductor 56, light source 34, and diode 55 due to the release of energy accumulated in inductor 56 (regenerated power).

Control circuit 54 detects a current flowing through inductor 58, via an inductor or the like (not illustrated) magnetically coupled with inductor 56. When control circuit 54 detects that the current flowing through inductor 56 has become zero during the OFF period of switching element 58, control circuit 54 again performs control to turn on switching element 58 only for the ON period corresponding to the dimming signal input from phase detection circuit 42. With such a high-frequency chopping operation, a current flows from AC power source 12 to dimming lighting circuit 32 with a near-sinusoidal waveform, and a high power factor is achieved. Furthermore, the ON period in the switching of switching element 53 is controlled and dimming is thereby performed according to the signal level of the dimming signal output from phase detection circuit 42—that is, according to the conduction phase angle of the AC voltage applied to input terminals 31.

It is to be noted that phase detection circuit 42 and control circuit 54 operate with the supply of source voltage Vcc generated from the output voltage of rectifier circuit 40 (generated by a circuit not illustrated).

Here, a feature of dimming lighting circuit 32 is that phase detection circuit 42 performs the following operation if the conduction phase angle detected when the phase-controlled AC voltage is applied to dimming lighting circuit 32 at power-on by power switch 24 is less than or equal to a predetermined angle. That is, for a predetermined time period (e.g., 1 second), phase detection circuit 42 generates, as a dimming signal, a substitute signal having a signal level corresponding to a conduction phase angle greater than the conduction phase angle detected, and outputs the substitute signal to control circuit 54. This is to cause DC-DC converter 50 to output a current corresponding to an adjusted dimming level higher than the original level (the actual dimming level) when the power is turned on with a low dimming level. This reduces the charging time of output smoothing capacitor 57, and thus reduces the time which elapses before light equivalent to the dimming level is emitted by light source 34 (lighting start-up time), as compared to the conventional techniques.

In the present embodiment, phase detection circuit 42 outputs, as the substitute signal, a signal having a signal level corresponding to a conduction phase angle greater than a predetermined angle. The predetermined angle is, for example, a conduction phase angle for causing light source 34 to emit light having about 10% of the brightness of light that light source 34 emits when the conduction phase angle is at maximum (full illumination). In this case, when the power is turned on with the dimming level less than or equal to 10% of the full illumination (e.g., 3%), a current for causing light source 34 to emit light having a brightness equivalent to about 10% of the full illumination is output from DC-DC converter 50 for a predetermined time period (e.g., 1 second) from the power-on. This, as a result, reduces the charging time of output smoothing capacitor 57 and rims reduces the lighting start-up time as compared to the case where such a substitute signal is not output. It is to be noted that the threshold of the conduction phase angle to be used for generating the substitute signal is set to about 10% of the full illumination in consideration of a threshold at which the user is expected to feel irritated by a long lighting start-up time. That is to say, when the power is turned on with the dimming level less than or equal to 10% of the full illumination, a current greater than in the normal case (where the dimming level is the actual dimming level) is output from DC-DC converter 50 for a predetermined time period, thereby making it possible to prevent many cases where the user feels that the lighting start-up time is long.

Conversely, if the conduction phase angle detected when the phase-controlled AC voltage is applied to dimming lighting circuit 32 at power-on by power switch 24 is greater than the predetermined angle, phase detection circuit 42 outputs a dimming signal having a signal level corresponding to the conduction phase angle detected and does not output the substitute signal. That is to say, phase detection circuit 42 performs a normal operation, according to the conduction phase angle. This is because the lighting start-up time is not long and special control is unnecessary in this case.

Figure 4:
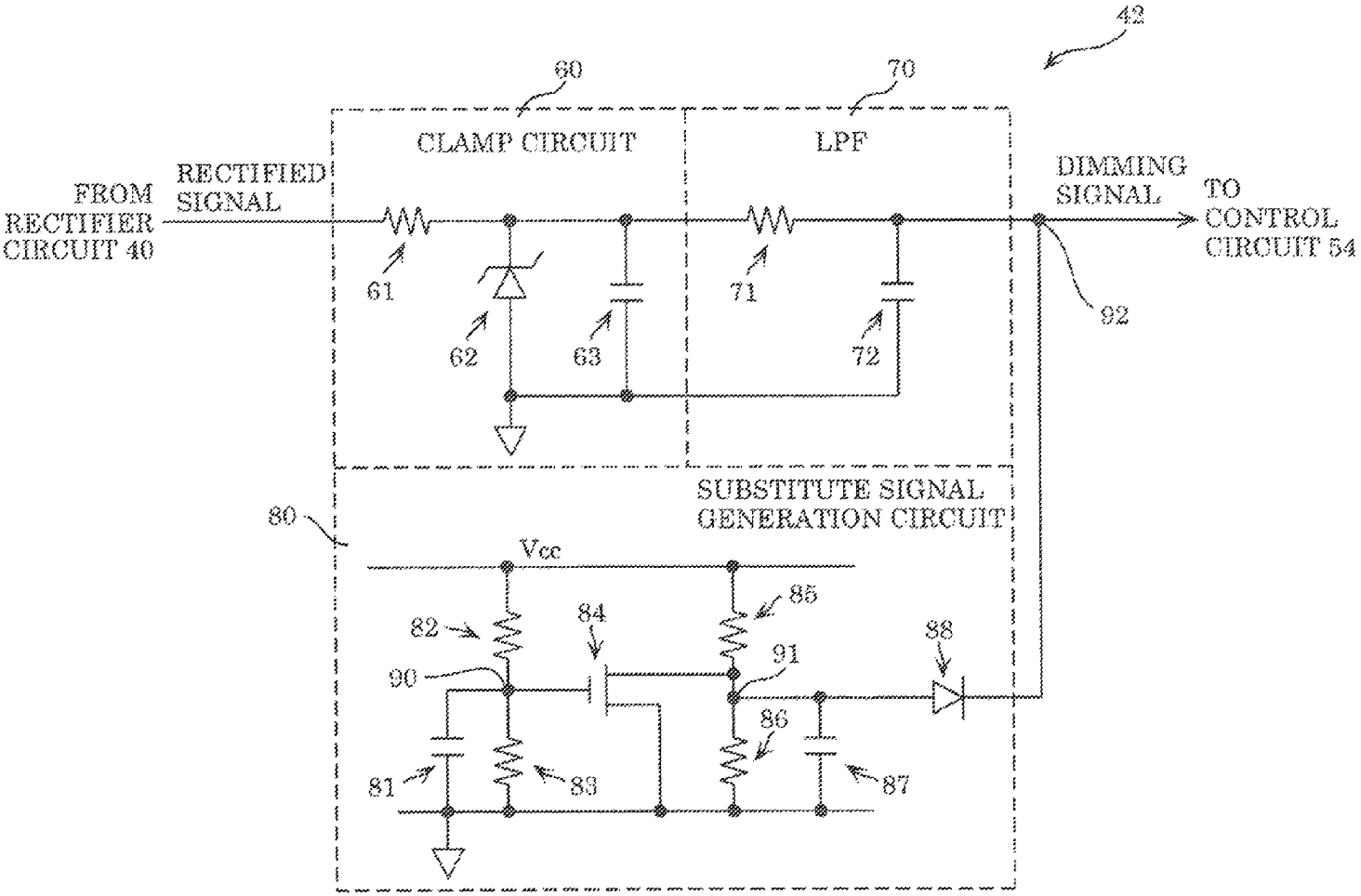
FIG. 4 is a circuit diagram of the phase detection circuit illustrated in FIG. 4.
Figure 5:
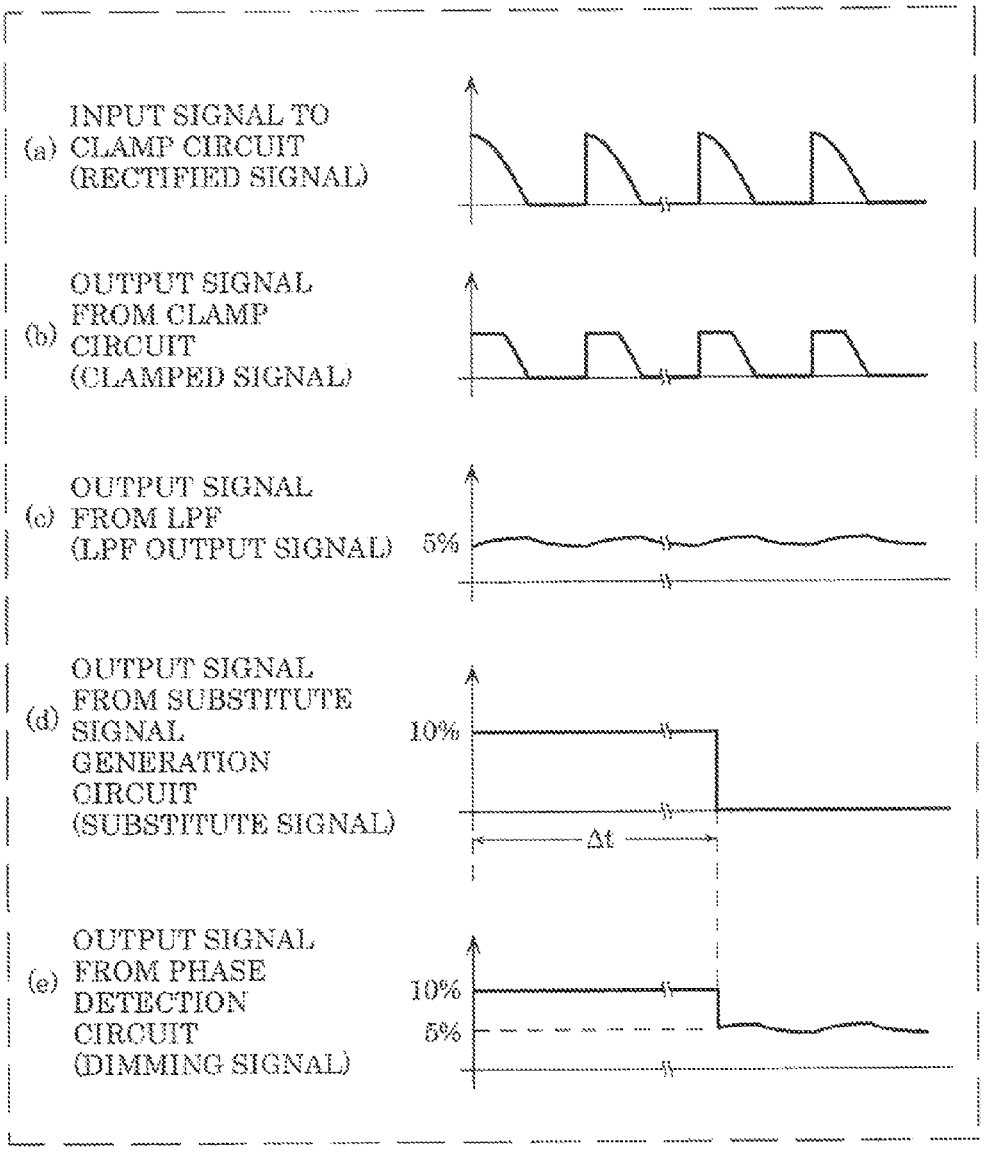
FIG. 5 is a timing diagram illustrating the waveforms of signals related to the phase detection circuit illustrated in FIG. 4.

FIG. 4 is a circuit diagram of phase detection circuit 42 illustrated in FIG. 3. Phase detection circuit 42 includes clamp circuit 60, low-pass filter (LPF) 70, and substitute signal generation circuit 80. FIG. 5 is a timing diagram illustrating the waveforms of signals related to phase detection circuit 42 illustrated in FIG. 4.

Clamp circuit 60 is a circuit which clamps a phase-controlled rectified signal output from rectifier circuit 40 (see (a) of FIG. 5), and includes resistor 61, Zener diode 82, and capacitor 88. The rectified signal (see (a) of FIG. 5) applied to clamp circuit 80 is clamped to a fixed voltage determined by Zener diode 62, applied is applied to LPF 70 as a clamped signal as illustrated in (b) of FIG. 5.

LFF 70 is a circuit which smoothes the clamped signal (see (b) of FIG. 5) output from clamp circuit 60, and includes resistor 71 and capacitor 72. From the clamped signal applied to LFF 70 (see (b) of FIG. 5), a high-frequency component corresponding to a time constant determined by resistor 71 and capacitor 72 is eliminated, so that the clamped signal becomes a DC signal (LFF output signal) as illustrated in (c) of FIG. 5 and is output from LPF 70.

In such a manner as described above, clamp circuit 60 and LPF 70 convert the conduction phase angle of the phase-controlled AC voltage applied to phase detection circuit 42 (the conduction phase angle of the rectified signal) into a voltage (voltage of LPF output signal).

Substitute signal generation circuit 80 is a circuit which generates, for a predetermined time period after power-on, a substitute signal having a signal level corresponding to a conduction phase angle greater than the conduction phase angle of the AC voltage applied to dimming lighting circuit 32. Substitute signal generation circuit 80 includes resistors 82, 83, 85, and 86, capacitors 81 and 87, switching element 84, and diode 88. When dimming lighting circuit 32 is powered on through power switch 24, source voltage Vcc is generated, and charging of capacitor 81 connected to connection point 90 of resistor 82 and resistor 88 starts. When predetermined time period Δt determined by resistor 82, resistor 83, and capacitor 81 elapses, the voltage at connection point 90 reaches a threshold voltage of switching element 84 and switching element 84 is turned on. As a remit, the potential of the voltage at connection point 91 of resistor 85 and resistor 86 decreases from a divided potential determined by resistor 85 and resistor 86 to a ground potential as illustrated in (d) of FIG. 5. The voltage change at connection point 91 is the substitute signal.

The substitute signal is combined with the LFF output signal at connection point 92 via diode 88, and is output from substitute signal generation circuit 80 as the dimming signal illustrated in (e) of FIG. 5. Diode 88 is connected to the output stage of substitute signal generation circuit 80. Thus, when combining the LPF output signal and the substitute signal, either the LPF output signal or the substitute signal, whichever having a higher voltage, is output from phase detection, circuit 42 as the dimming signal. In the example illustrated in FIG. 5, for predetermined time period Δt, the substitute signal is output as the dimming signal because the voltage of the substitute signal is higher than the voltage of the LPF output signal. After a lapse of predetermined time period Δt, the LPF output signal is output as the dimming signal because the voltage of the LPF output signal is higher than the voltage of the substitute signal. To be precise, a comparison is made between the sum of the voltage of the substitute signal and a voltage drop across diode 88 and the voltage of the LPF output signal, and either the LPF output signal or the substitute signal, whichever having a higher voltage, is output as the dimming signal. However, in this written description, the voltage drop across diode 88 is ignored for convenience of description.

With such an operation, phase detection circuit 42 performs the following operation for predetermined time period Δt determined by resistor 82, resistor 83, and capacitor 81, after dimming lighting circuit 32 is powered on through power switch 24. That is, when the voltage of the LPF output signal is less than or equal to the voltage of the substitute signal (a divided voltage determined by resistor 85 and resistor 86), it is detected that the conduction phase angle of the rectified signal is less than or equal to a predetermined angle corresponding to the divided voltage. Then, the substitute signal having a voltage (the divided voltage) higher than the voltage of the LPF output signal is output as the dimming signal. In other words, the substitute signal having a signal level corresponding to a conduction phase angle (here, the predetermined angle) greater than the conduction phase angle of the rectified signal is output as the dimming signal.

Figure 6:
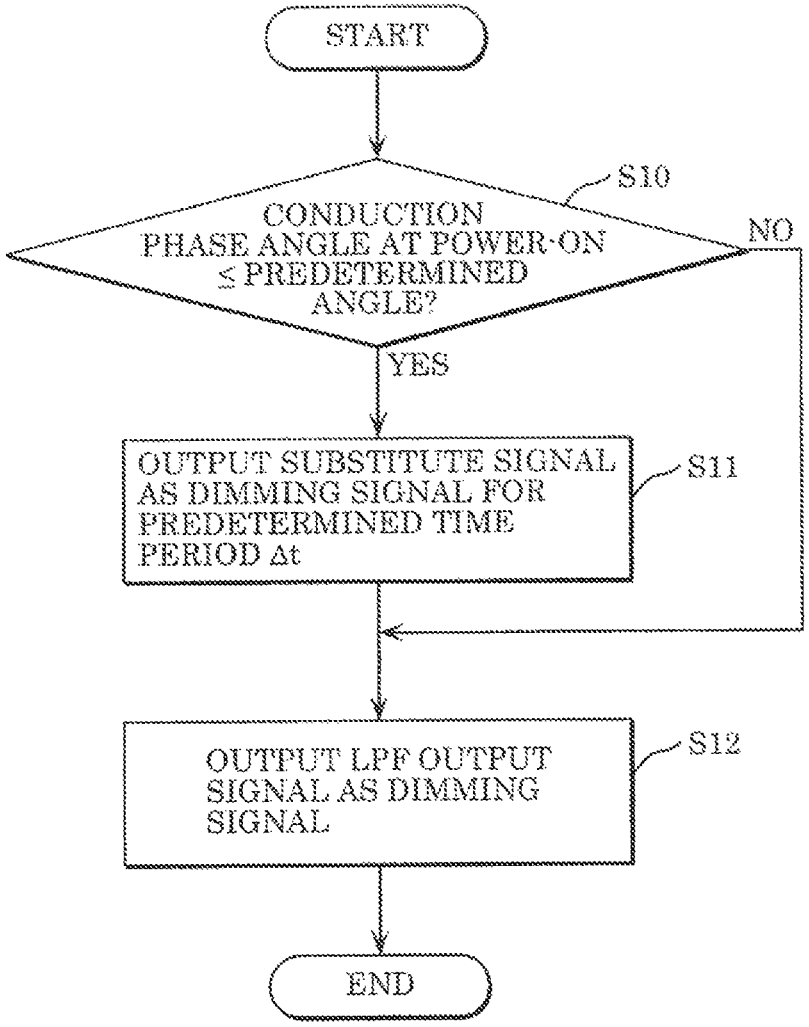
FIG. 6 is a flow chart illustrating an operation of a dimming system according to an embodiment.

FIG. 6 is a flow chart illustrating an operation, of dimming system 10 according to the present embodiment. When an AC voltage is applied to dimming lighting circuit 32 at power-on by power switch 24, phase detection circuit 42 makes a comparison between the conduction phase angle of the rectified signal applied to phase detection circuit 42 and a predetermined angle (S10). This comparison is equivalent to combination of the substitute signal generated by substitute signal generation circuit 80 with the LPF output signal output from LPF 70, which is performed by phase detection circuit 42 via diode 88. The predetermined angle corresponds to the divided voltage determined by resistor 85 and resistor 86 of phase detection circuit 42.

When the comparison shows that the conduction phase angle of the rectified signal is less than or equal to the predetermined angle (YES in S10), phase detection circuit 42 outputs the substitute signal as the dimming signal for predetermined time period Δt (S11). The predetermined time period is a time period determined by resistor 82, resistor 83, and capacitor 81. The voltage of the substitute signal is a voltage obtained by dividing source voltage Vcc by resistor 85 and resistor 86. The voltage of the substitute signal has a signal level corresponding to the conduction phase angle greater than the conduction phase angle of the rectified signal, and thus a current corresponding to an adjusted dimming level higher than the original level (the actual dimming level) is output from DC-DC converter 50 for predetermined time period Δt. This reduces the charging time of output smoothing capacitor 57 of DC-DC converter 50 as compared to the normal case (where the dimming level is the actual dimming level), and thus reduces the lighting start-up time as compared to the conventional techniques.

After a lapse of predetermined time period Δt, phase detection circuit 42 outputs the LPF output signal as the dimming signal (S12). With this, a current corresponding to the actual dimming level is output from DC-DC converter 50, and proper dimming control is performed.

On the other hand, when the conduction phase angle of the rectified signal is greater than the predetermined angle (NO in S10), phase detection circuit 42 outputs the LPF output signal as the dimming signal (S12) and does not output the substitute signal, and normal dimming control is performed. That is to say, a current corresponding to the actual, dimming level is output from DC-DC converter 50.

As described above, dimming lighting circuit 32 according to the present embodiment is a circuit which receives a phase-controlled AC voltage and supplies light source 34 with a DC current, and includes rectifier circuit 40, phase detection circuit 42, and DC-DC converter 50. Rectifier circuit 40 rectifies the AC voltage to output a DC voltage. Phase detection circuit 42 detects the conduction phase angle of the AC voltage and outputs a dimming signal having a signal level corresponding to the conduction phase angle detected. DC-DC converter 50 receives the DC voltage output from rectifier circuit 40 and supplies light source 34 with a DC current corresponding to the signal level of the dimming signal output from phase detection circuit 42. If the conduction phase angle detected when dimming lighting circuit 32 receives an AC voltage at power-on is less than or equal to the predetermined angle, phase detection circuit 42 outputs, as the dimming signal, the substitute signal having a signal level corresponding to the conduction phase angle greater than the conduction phase angle detected, for a predetermined time period.

With this, when the conduction phase angle detected at power on is less than or equal to the predetermined angle, phase detection circuit 42 outputs, instead of the original dimming signal, the substitute signal having a signal level corresponding to the conduction phase angle greater than the conduction phase angle detected to DC-DC converter 50 for a predetermined time period. This means that when the power is turned on with a low dimming level, the output smoothing capacitor is charged with a current corresponding to an adjusted dimming level higher than the original level, thus reducing the lighting start-up time as compared to the conventional techniques.

Furthermore, phase detection circuit 42 outputs, as the substitute signal, a signal having a signal level corresponding to the conduction phase angle greater than the predetermined angle.

With this, if the conduction phase angle detected at power-on is less than or equal to the predetermined angle, phase detection circuit 42 outputs the substitute signal having a signal level corresponding to the conduction phase angle greater than the predetermined angle. This means that when the power is turned on with a low dimming level, the output smoothing capacitor is charged with a current corresponding to the conduction phase angle greater than the predetermined angle, thus reliably reducing the lighting start-up time as compared to the conventional techniques.

Moreover, if the conduction phase angle detected when an AC voltage is applied to dimming lighting circuit 32 at power-on is greater than the predetermined angle, phase detection circuit 42 outputs the dimming signal having a signal level corresponding to the conduction phase angle detected and does not output the substitute signal.

With this, only when the conduction phase angle detected at power-on is less than or equal to the predetermined angle, phase detection circuit 42 outputs, instead of the original dimming signal, the substitute signal having a signal level corresponding to the conduction phase angle greater than the conduction phase angle detected, for a predetermined time period. This means that the output smoothing capacitor is charged with a current corresponding to the adjusted dimming level higher than the original level only when the power is turned on with a low dimming level. This, as a result, prevents an unnecessary increase in the current immediately after the power-on at normal lighting start-up e.g., when, the power is turned on with a high dimming level, thereby suppressing the occurrence of unnatural light emission immediately after the power-on.

In the exemplary embodiment, the predetermined angle is a conduction phase angle for causing light source 34 to emit light having about 10% of the brightness of light that light source 34 emits when the conduction phase angle is at maximum.

With this, when the dimming level at power-on is less than or equal to 10%, phase detection circuit 42 outputs, instead of the original dimming signal the substitute signal having a signal level corresponding to the conduction phase angle greater than the conduction phase angle detected, for a predetermined time period. Since the predetermined angle is set to a value at which the user is expected to feel irritated by a long lighting start-up time, the lighting start-up time is appropriately reduced.

In the present embodiment, luminaire 30 includes light source 34 and dimming lighting circuit 32 which supplies light source 34 with a DC current.

This means that when the power is turned on with a low dimming level, the output smoothing capacitor is charged with a current corresponding to the adjusted dimming level higher than the original level, thus reducing the lighting start-up time as compared to the conventional techniques.

The dimming lighting circuit and the luminaire according to the present disclosure have been described above based on an embodiment, but the present disclosure is not limited to this embodiment. Various modifications to this embodiment which may be conceived by those skilled in the art, as well as embodiments resulting from combinations of some of the structural elements of this embodiment are to be included within the scope of the present disclosure, as long as such modifications and embodiments do not depart from the essence of the present disclosure.

For example, when the conduction phase angle of the rectified signal applied is less than or equal to the predetermined angle, phase detection circuit 42 illustrated in FIG. 4 outputs the substitute signal having a signal level corresponding to the conduction phase angle corresponding to the predetermined angle, but the signal level of the substitute signal is not limited to such a signal level. It is sufficient as long as phase detection circuit 42 outputs the substitute signal having a signal level corresponding to the conduction phase angle greater than the conduction phase angle of the rectified signal applied. This means that when the power is turned on with a low dimming level, the output smoothing capacitor is charged with a current corresponding to an adjusted dimming level higher than the original level, thus reducing the lighting start-up time as compared to the conventional techniques.

The angle equivalent to about 10% of the full illumination is used as the predetermined angle, but the predetermined angle is not limited to this. The predetermined angle may be set to an angle equivalent to, for example, 5%, 15%, or 20% of the full illumination as appropriate, depending on a value such as the capacitance value of output smoothing capacitor 57. Since the predetermined angle corresponds to the divided voltage determined by resistor 85 and resistor 86 of phase detection circuit 42, the predetermined angle can be set to an appropriate angle by adjusting resistor 85 and resistor 86.

Light source 34 in the above embodiment is an LED but is not limited to this and may be a solid-state light-emitting device such as an organic electroluminescent (EL) device.

Dimming lighting circuit 32 is a converter of the PPG one-converter type in the above embodiment but is not limited to this and may be a DC-DC converter having an output smoothing capacitor with a relatively large capacity. This is because phase detection circuit 42 in the above embodiment enables reduction of the charging time of the output smoothing capacitor at power-on.

DC-DC converter 50 in the above embodiment is a buck converter but is not limited to this and may be a boost converter or a buck-boost converter. This is because phase detection circuit 42 in the above embodiment enables reduction, of the charging time of the output smoothing capacitor at power-on.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A dimming lighting circuit which receives an AC voltage which is phase-controlled, and supplies a light source with a DC current, the dimming lighting circuit comprising:

a rectifier circuit which rectifies the AC voltage to output a DC voltage;

a phase detection circuit which detects a conduction phase angle of the AC voltage and outputs a dimming signal having a signal level corresponding to the conduction phase angle detected; and a converter which receives the DC voltage output from the rectifier circuit and supplies the light source with a DC current corresponding to a signal level of the dimming signal output from the phase detection circuit, wherein, if the conduction phase angle detected when the dimming lighting circuit receives the AC voltage at power-on is less than or equal to a predetermined angle, the phase detection circuit outputs, as the dimming signal, a substitute signal having a signal level corresponding to a conduction phase angle greater than the conduction phase angle detected, for a predetermined time period after the power-on, and outputs, as the dimming signal, the dimming signal having the signal level corresponding to the conduction phase angle detected, after the predetermined time period.

2. The dimming lighting circuit according to claim 1, wherein the phase detection circuit outputs, as the substitute signal, a signal having a signal level corresponding to a conduction phase angle greater than the predetermined angle.

3. The dimming lighting circuit according to claim 1, wherein, if the conduction phase angle detected when the dimming lighting circuit receives the AC voltage at power-on is greater than the predetermined angle, the phase detection circuit outputs the dimming signal having the signal level corresponding to the conduction phase angle detected and does not output the substitute signal.

4. The dimming lighting circuit according to claim 1, wherein the predetermined angle is a conduction phase angle for causing the light source to emit light at about 10% of brightness of light that the light source emits when the conduction phase angle is at maximum.

5. A luminaire comprising:

a light source; and the dimming lighting circuit according to claim 1 which supplies the light source with a DC current.

* * * * *